US008268233B2

(12) United States Patent
MacRae

(10) Patent No.: US 8,268,233 B2
(45) Date of Patent: Sep. 18, 2012

(54) EDDY-FREE HIGH VELOCITY COOLER

(76) Inventor: Allan J. MacRae, Hayward, CA (US)

( * ) Notice: Subject to any disclaimer, the term of this patent is extended or adjusted under 35 U.S.C. 154(b) by 488 days.

(21) Appl. No.: 12/581,088

(22) Filed: Oct. 16, 2009

(65) Prior Publication Data

US 2011/0088600 A1 Apr. 21, 2011

(51) Int. Cl.

| | |
|---|---|
| ***C21B 7/16*** | (2006.01) |
| ***F23M 5/08*** | (2006.01) |
| *F23K 5/00* | (2006.01) |
| *C21B 7/00* | (2006.01) |

(52) U.S. Cl. ..... 266/270; 266/46; 266/47; 266/190; 266/191; 266/197; 266/265; 29/890.035; 29/889.721; 110/180; 110/182.5

(58) Field of Classification Search ..... 266/46–47, 266/190–191, 197, 265, 270; 29/890.035, 29/889.721; 110/180, 182.5
See application file for complete search history.

(56) References Cited

U.S. PATENT DOCUMENTS 6,351,381 B1 * 2/2002 Bilski et al. ..... 361/695
2007/0267786 A1 * 11/2007 Higgins et al. ..... 266/46

* cited by examiner

*Primary Examiner* — Lois Zheng
(74) *Attorney, Agent, or Firm* — Richard B. Main

(57) ABSTRACT

A cooling system comprises serpentine cooling fluid passages cast into a work piece with carefully controlled turning radii and profiles. Individual interdigitated baffles are contoured in the plane of coolant flow to have walls that thicken and then round off at their distal ends. The outside radii at these turns is similarly rounded and controlled such that the coolant flow will not be swirled into eddies.

4 Claims, 7 Drawing Sheets

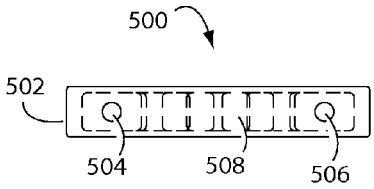
Fig. 5B
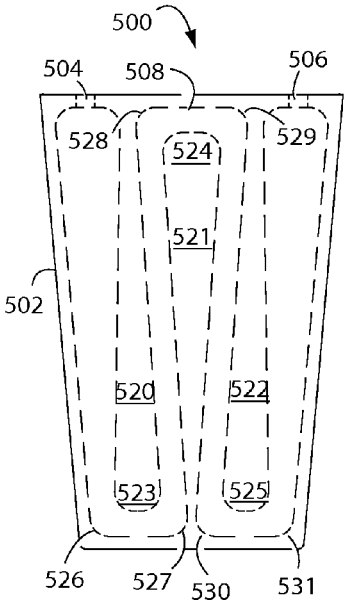
Fig. 5C
Fig. 5A
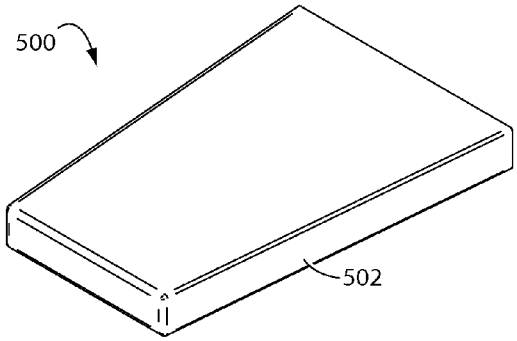
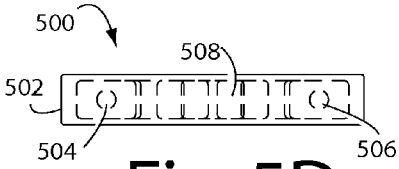
Fig. 5D
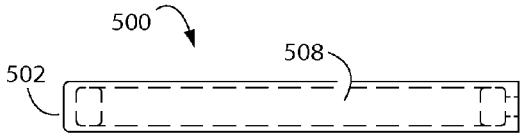
Fig. 5E

EDDY-FREE HIGH VELOCITY COOLER

BACKGROUND

1. Field of the Invention

The present invention relates to gas and fluid cooling of equipment, and more particularly to methods and devices for eliminating eddy currents in high velocity coolant flows through serpentine passageways.

2. Description of the Prior Art

Cooling is widely used in equipment and machines of all sizes and descriptions. Three modes of cooling, or heat transfer, depend on thermal radiation, heat conduction, and heat convention. Engines and other devices can generate enough heat that will destroy themselves if cooling were not used to keep the operating temperatures within acceptable limits. Radiators in cars are a familiar way that water coolants are circulated through a gas engine to keep its operating temperatures under 200° F. The excess heat is transferred to the air blowing through the engine compartment.

Fluid and gas-cooled castings and machined coolers are widely used in the roofs, walls and hearths of metallurgical furnaces, molds for solidification of molten materials, burners, lances, electrode clamps for conducting electricity in high voltage equipment, tuyere forced-air nozzles in iron smelting blast furnaces, etc. The most common cooling medias employed are forced air, circulating water, common oils, and synthetic oils.

Cooling passages can be manufactured inside metal pieces by drilling, machining, or casting. Coolant pipes can be cast inside the bulk of the metal piece, or the passages can be cast inside using thin wall techniques as is conventional in automobile engine blocks. For example, a copper-nickel pipe can be cast inside a bulk copper piece.

Drilling is usually not appropriate when complex cooling patterns are needed, so drilling has been limited to straight line passages. Cast-in-pipes provide excellent liquid conduits for the reliable containment of cooling mediums, but the passage shapes and layouts obtainable with piping are constrained by pipe size, coupling, bending, and welding considerations.

The amount of cooling possible in cast-in-pipe implementations is further limited by standard bend dimensions. For example, in a one inch Schedule-40 diameter pipe with a short radius 180° return, the center-to-center distance between the pipes is two times the nominal diameter, or two inches. But the inside diameter of the pipe is only 1.049 inches. So, if the pipe is bonded to a casting, then the width of the cooling channel is less than 50% of the bulk, based on minimum center-to-center spacing constraints.

The round cross section of pipes further reduces the effective cooling channel area, and thus the flow volume. A rectangular cross section would better fill the bulk area available.

Castings can employ cored or machined patterns, and typical cooling passages most commonly use a serpentine pattern implemented with thin-wall baffles. However, these simple designs can produce significant eddies in the coolant flow just past where the coolant is turned in each loop, and problems in cooling uniformity due to these eddies are amplified when the coolant velocity is pushed to high levels.

Equipment pieces with cored water passages can be manufactured in a single piece. But, the sand cores themselves must somehow be suspended in the piece mold to define the water passages during the casting pour. Any points where the sand core supports passed through the casting walls for containing the molten metal in the pour must be closed over later using plugs or welds.

The leak tightness in a metallic gas or fluid cooled piece can be improved by hot working or forging the hot face to refine the metal crystal grain size. For example, the average grain size for cast copper can be reduced from approximately ten millimeters to less than one millimeter using hot rolling, hot pressing, etc. The water passages are then milled in to the face of the worked part. A cover plate or second piece is required to complete the water passage and finish the milled piece.

Rectangular cross-section coolant passages with rounded corners are entirely possible and practical to do in castings with cored or machined cooling channels. The cooling medium can thereby occupy a large percentage of the available height and width inside the piece. Less metal would therefore be necessary, and cooling efficiencies would increase proportionately.

The large surface areas of the coolant passageways inside a cored or machined pattern can significantly increase the amount of heat transfer possible. However, the flow regime within the fluid coolant in conventional castings is typically quite poor. Eddies tend to form in the coolant flows aft of where they are being turned by the baffle ends. Hot spots can then build up because the coolant is ineffectually spinning around in small circles and can not carry any absorbed heat away. The heat at those spots can build up high enough to boil the coolant, and that can lead to the failure of the part and the connecting piping.

What is needed is a better baffle and passageway design that eliminates the inefficient eddies and their disastrous consequences in fast flowing coolants.

SUMMARY OF THE INVENTION

Briefly, a cooling system embodiment of the present invention comprises serpentine cooling fluid passages cast or milled into a work piece with carefully controlled turning radii and profiles. Individual interdigitated baffles are contoured in the plane of coolant flow to have walls that thicken and then round off at their distal ends. The outside radii at these turns are similarly rounded and controlled such that the coolant flow will not be swirled into eddies.

These and other objects and advantages of the present invention will no doubt become obvious to those of ordinary skill in the art after having read the following detailed description of the preferred embodiments which are illustrated in the various drawing figures.

IN THE DRAWINGS

FIGS. 5A-5E are, respectively, perspective, wide end, top, narrow end, and side view diagrams of a cooler plate embodiment of the present invention.

Figure 1A:
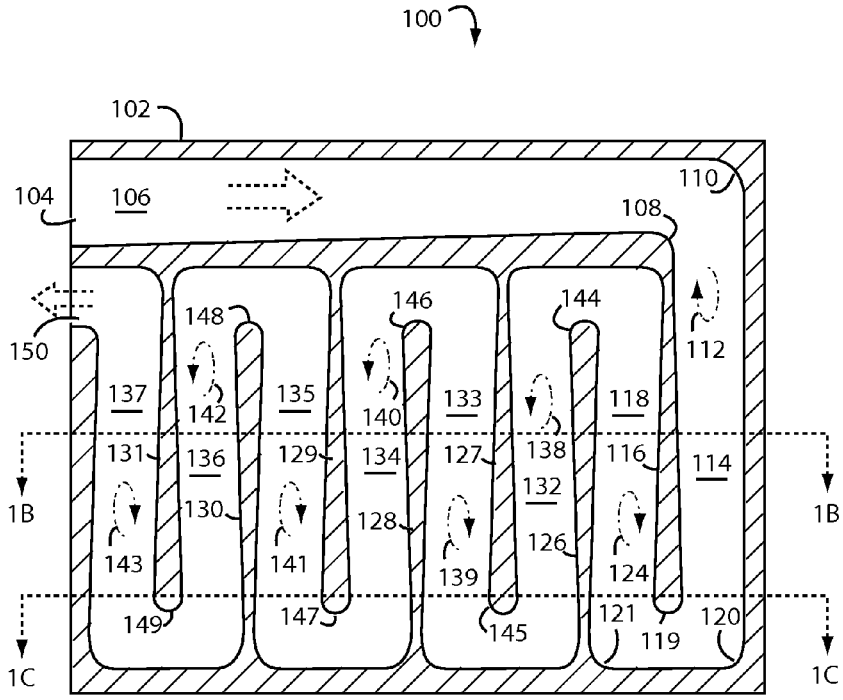
FIG. 1A is a cross sectional diagram of a cooling system embodiment of the present invention taken along the general plane of a serpentine coolant passageway cast within.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENT

Figure 1B:
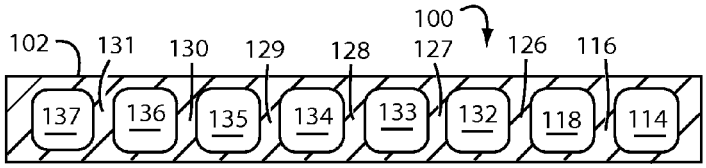
FIG. 1B is a cross sectional diagram of the cooling system of FIG. 1A taken along line 1B-1B, and across the general plane of a serpentine coolant passageway cast within.
Figure 1C:
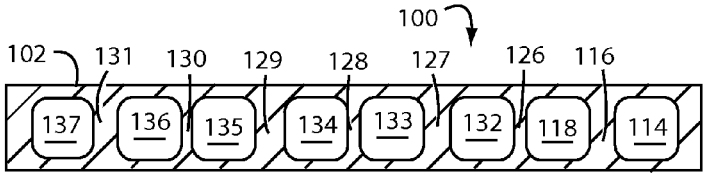
FIG. 1C is a cross sectional diagram of the cooling system of FIG. 1A taken along line 1C-1C, and across the general plane of a serpentine coolant passageway cast within where the ends of several baffles are thickest.

FIGS. 1A-1C represents a cooling system embodiment of the present invention, and is referred to herein by the general reference numeral 100. Cooling system 100 comprises a cast metal workpiece 102 with an inlet 104 to a serpentine passageway 106 for a circulating fluid coolant. A first turn in the serpentine passageway 106 has an inside turn radius 108 and an outside turn radius 110 with respect to the general plane of the serpentine passageway 106. The inside and outside turn radii 108 and 110 are dimensioned and shaped to eliminate eddies 112 in the coolant flow at these points and just downstream.

In general, making the turning radii broader and wider will, at some point, eliminate eddies 112 in the coolant flow, but this must be balanced with the negative effects that thickening the walls of casting material to accommodate the rounded geometry will have on heat transfer performance. One way to find the optimum balance point is to employ computational fluid dynamics modeling software in simulations.

A first serpentine loop 114 turns around a first baffle 116 into a second serpentine loop 118. Baffle 116 is thickened toward a radius end 119 facing two outside radius corners 120 and 121. Such radius end 119, and radius corners 120 and 121, are proportioned to eliminate any eddy 124 that would otherwise form in the coolant flow if the turns were too sharp and abrupt.

A continuing series of baffles 126-131 are disposed in the serpentine passageway 106 to provide for additional turning of the circulating fluid coolant into each of a following series of serpentine loops 132-137. Each such turn invites the formation of more eddies 138-143 in the coolant flow that will swirl in the same plane as the serpentine passageway 106. Any such eddie formation can reduce the cooling performance in its immediate vicinity in the cast metal workpiece 102. In the applications contemplated for embodiments of the present invention, such loss of cooling performance at any spot can provoke a catastrophic failure incited by the high environmental heats surrounding it.

Each of baffles 126-131 is also thickened at their distal ends 144-149 and finished in a radius end. The corresponding outside corners that each faces are similar to radius corners 120 and 121. The coolant eventually exits to a chiller through an outlet 150.

Computational fluid dynamics (CFD) is a branch of fluid mechanics that uses numerical methods and algorithms to solve and analyze problems that involve fluid flows. Computers are used to perform the many calculations required to simulate interactions of fluids with surfaces defined by boundary conditions. Specialized software is commercially available that can report to a user the heat transfer performance and fluid velocities at selected points or modeling cells in a cooling system. For example, the ANSYS CFX software product marketed by ANSYS, Inc. (Canonsburg, Pa.) provides passage fluid flow modeling CFD software and engineering services. See, www.ansys.com/products/fluid-dynamics/cfx/. When used to construct embodiments of the present invention, the prospect of any eddies 112, 124, and 138-143 in the coolant are revealed by the modeling cells which are calculated to have zero velocity or whirling flows.

In FIGS. 1B and 1C, each loop 114, 118, and 132-137, of serpentine passageway 106 can be seen to have a generally rectangular cross-section. The cross-sectional area of the serpentine passageway 106 is held constant as much as is possible given the application. If the serpentine passageway 106 must be narrowed or widened at any point, the transitions should be gradual so as not to induce the formation of eddies.

Figure 2A:
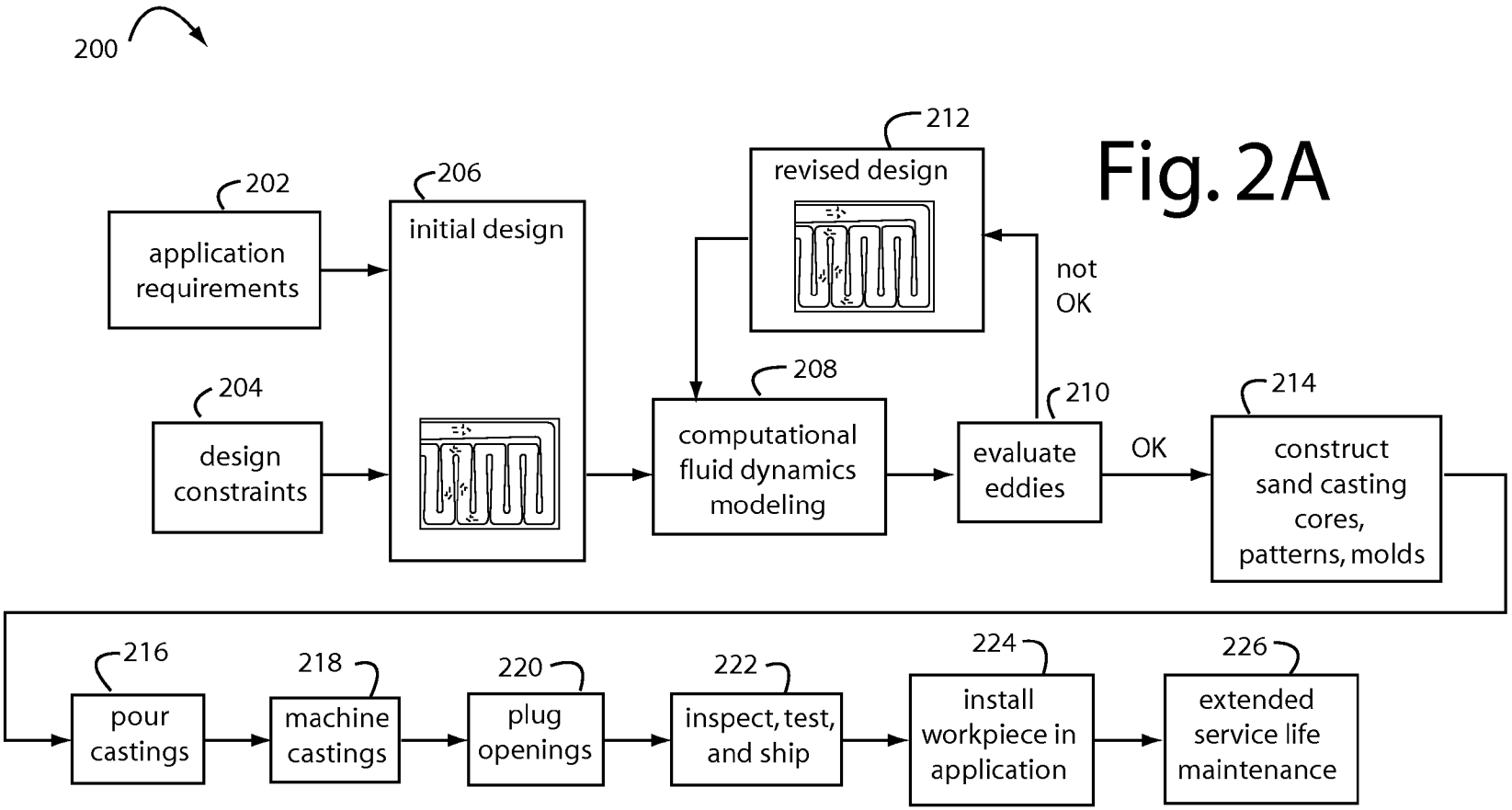
FIGS. 2A-2B are flowchart diagrams of similar method embodiments of the present invention for manufacturing the cooling systems, coolers, and tuyeres of FIGS. 1A, 1B, 1C, 3, 4A, 4B, and 4C, 5A-5E, and 6.

FIG. 2A represents a method embodiment of the present invention that can produce the cooling system 100 of FIG. 1, and is referred to herein by the general reference numeral 200. Method 200 begins with application requirements 202 that define the performance needed and the environment a cooling system is to operate within. These requirements can include, e.g., external heat loads, inlet pressures, etc. Design constraints 204 further restrict the materials and dimensions available in the cooling system design. An initial design 206 represents a prototype or archetype, and would include the rounded baffle ends and inside corner relieving as represented in FIGS. 1A-1C, 4A-4C, 5A-5E, and 6. A computational fluid dynamic modeling software 208, such as ANSYS CFX, running on a suitable computer system platform produces thermal transfer and velocity simulations for the particular design being iterated. A step 210 presents information so a trained operator can evaluate whether the design needs further tweaking, especially in the baffle end radii and facing inside corner radii of the serpentine passages inside the cooling system. If so, a revised design 212 is resubmitted to the computational fluid dynamic modeling software 208. The design iterations can stop when the eddies have apparently been completely eliminated.

Otherwise, if the design is finalized, then sand casting cores can be constructed in a step 214. The castings are poured in a step 216, and machined in a step 218. The sand casting cores probably need stems to support them in position, and after the casting and machining is complete the residual holes in the castings can be plugged in a step 220. A step 222 is used to inspect, test, and ship the final cooling system. These workpieces are installed in their particular applications in a step 224.

A principal advantage of the present invention is that workpiece embodiments will have an extended service life that can be budgeted and maintained in a step 226.

Figure 2B:
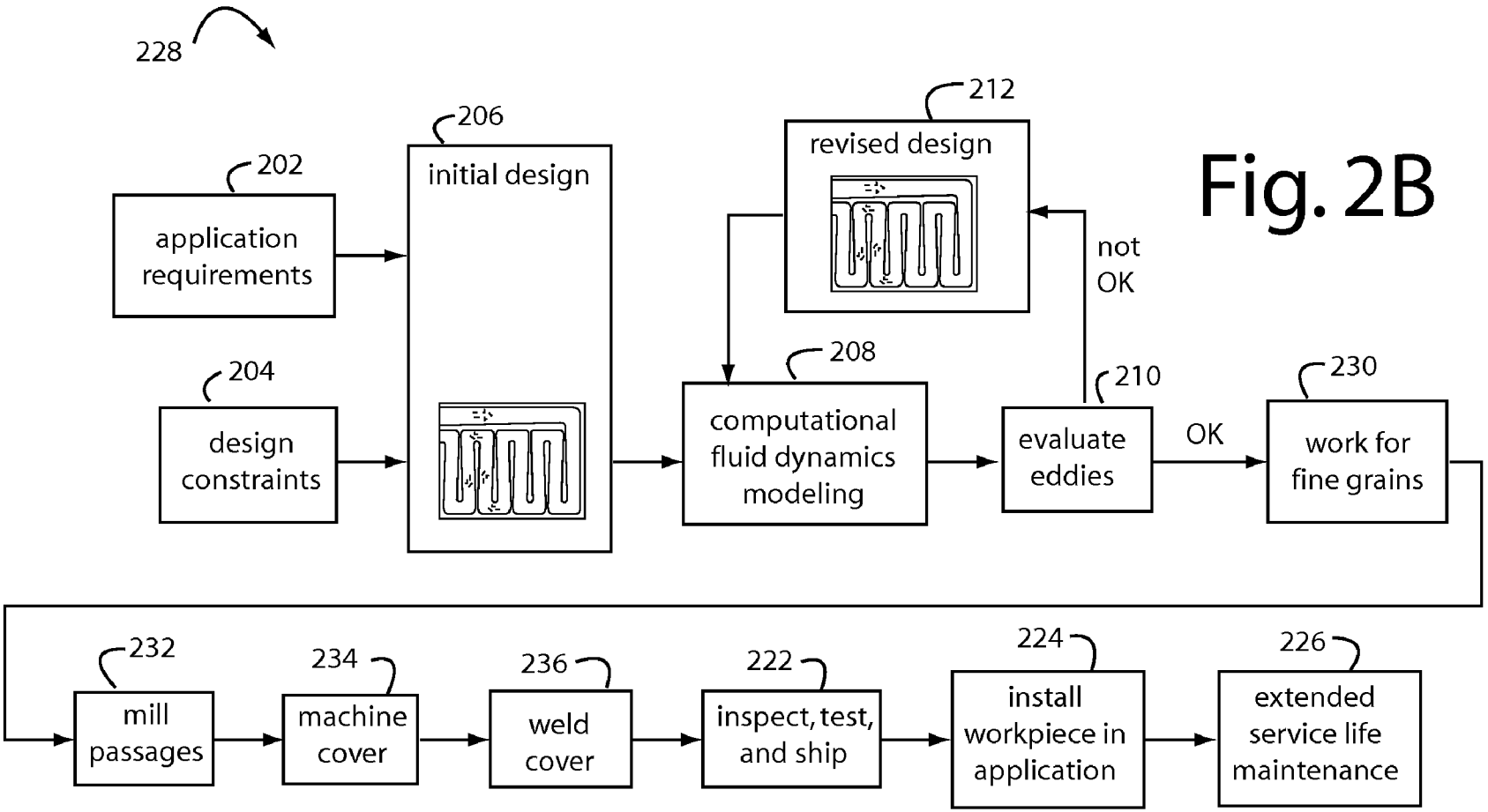

FIG. 2B represents another method embodiment of the present invention that can produce a milled cooler, and is referred to herein by the general reference numeral 228. Method 228 is very similar to method 200, and begins with application requirements 202 that define the performance needed and the environment a cooling system is to operate within. These requirements can include, e.g., external heat loads, inlet pressures, etc. Design constraints 204 further restrict the materials and dimensions available in the cooling system design. An initial design 206 represents a prototype or archetype, and would include the rounded baffle ends and inside corner relieving as represented in FIGS. 1A-1C, 4A-4C, 5A-5E, and 6. A computational fluid dynamic modeling software 208 running on a suitable computer system platform produces thermal transfer and velocity simulations for the particular design being iterated. A step 210 presents information so a trained operator can evaluate whether the design needs further tweaking, especially in the baffle end radii and facing inside corner radii of the serpentine passages inside the cooling system. If so, a revised design 212 is resubmitted to the computational fluid dynamic modeling software 208. The design iterations can stop when the eddies have apparently been completely eliminated.

At this point method 228 differs, if the design is finalized, then a piece is found or worked to obtain fine grain sizes in a step 230. The passages are milled in a step 232, and a passageway cover is machined in a step 234. The cover is welded on in a step 236. As in method 200, a step 222 is used to inspect, test, and ship the final cooling system. These workpieces are installed in their particular applications in a step 224. The embodiments will have an extended service life that is budgeted and maintained in a step 226.

Figure 3:
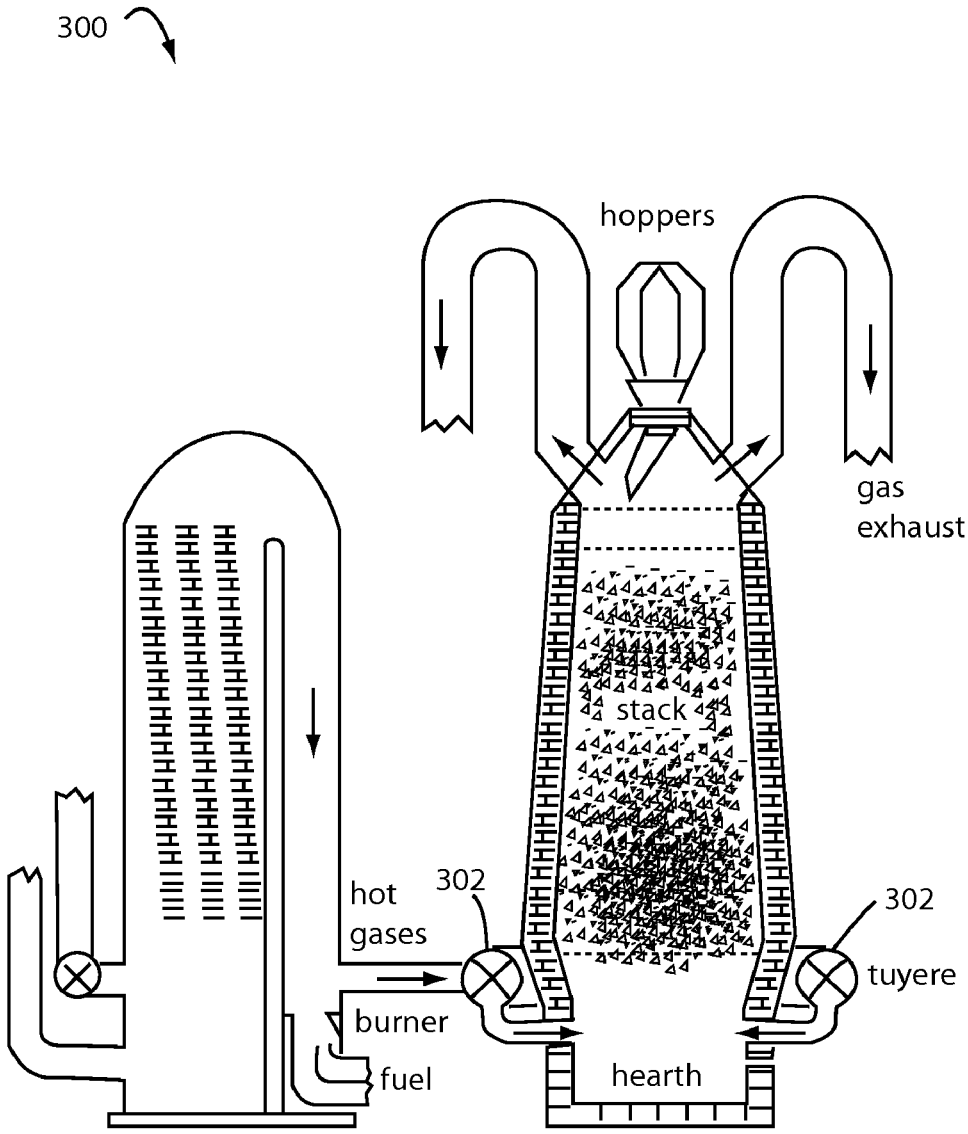
FIG. 3 is a cutaway diagram of a blast furnace embodiment of the present invention that can include the tuyeres of FIGS. 4A, 4B, and 4C.

FIG. 3 represents a blast furnace 300 embodiment of the present invention in which a number of tuyeres 302 are used to introduce very hot air into the smelting process. The tuyeres resemble nozzles and their close proximity to the iron smelting requires that they be liquid cooled and constructed of copper.

Blast furnaces chemically reduce and physically convert iron oxides into liquid iron. Blast furnaces are very large, steel stacks lined with refractory brick that are fed a mixture of iron ore, coke and limestone from the top. Preheated air is blown into the bottom through tuyeres. Liquid iron droplets descend to the bottom of the furnace where they collect as slag and liquid iron. These are periodically drained from the furnace as the bottom fills up.

The hot air blown into the furnace at the bottom gets involved in many chemical reactions as it percolates to the top. Blast furnaces are run continuously for years with only short interrupts for maintenance. A common reason to interrupt the otherwise continuous operation of an iron smelting blast furnace is to change out its worn or damaged tuyeres. Tuyeres that last longer and suffer fewer injuries are therefore highly desirable.

Raw ore removed from the earth includes Hematite ($Fe_2O_3$) or Magnetite ($Fe_3O_4$) with an iron content of 50% to 70%, and is sized into small pieces about an inch in diameter. An iron-rich powder can be rolled into balls and fired in a furnace to produce marble-sized pellets with 60% to 65% iron. Sinter can also be used which is produced from fine raw ore, coke, sand-sized limestone and waste materials with iron. The fines mixed together for a desired product chemistry. The raw material mix is then placed on a sintering strand and ignited by a gas fired furnace to fuse the coke fines into larger size pieces. The iron ore, pellets and sinter are smelted into the liquid iron produced by the blast furnace. Any of remaining impurities go in to the liquid slag.

Hard pieces of coke with high energy values provide the permeability, heat, and gases needed to reduce and melt the iron ore, pellets and sinter.

The final raw material in the iron making process is limestone. The limestone is removed from the earth by blasting with explosives. It is then crushed and screened to a size that ranges from 0.5 inch to 1.5 inch to become blast furnace flux. This flux can be pure high calcium limestone, dolomitic limestone containing magnesia or a blend of the two types of limestone.

Since the limestone melts and becomes the slag that removes sulphur and other impurities, the blast furnace operator can adjust the blend accordingly to the desired slag chemistry. A blend target would be to create a low melting point, a high fluidity, and other optimum properties.

All of the raw materials are stored in an ore field and transferred to a nearby stock-house before charging. Once these materials are loaded into the furnace top, they go through numerous chemical and physical reactions as they descend to the bottom of the furnace.

The iron oxides drop through a series of purifying reactions to soften, melt and finally trickle out through the coke as liquid iron to the bottom of the furnace. The coke itself drops to the bottom of the furnace where preheated air and hot blasts from the tuyeres enters the blast furnace. The coke is ignited by the hot blast and immediately reacts to generate more heat.

The reaction takes place in the presence of excess carbon at a high temperature, so the carbon dioxide is reduced to carbon monoxide. The carbon monoxide reduces the iron ore in iron oxide reactions. The limestone also descends in the blast furnace, but it remains a solid while going through a first reaction, $CaCO_3=CaO+CO_2$. Such reaction requires energy and starts at about 875° C. The CaO formed from the reaction is used to remove sulphur from the iron, and is necessary before the hot metal can become steel. The sulphur removing reaction is, $FeS+CaO+C=CaS+FeO+CO$. The CaS becomes part of the slag. The slag is also formed from any remaining Silica ($SiO_2$), Alumina ($Al_2O_3$), Magnesia (MgO) or Calcia (CaO) that entered with the iron ore, pellets, sinter or coke. The liquid slag then trickles through the coke bed to the bottom of the furnace where it will float on top of the more dense liquid iron.

Hot dirty gases exiting the top of the blast furnace proceed through gas cleaning equipment so particulate matter can be removed and the gas cooled. This gas has considerable energy value, so it is burned as a fuel in hot blast stoves that are used to preheat the air entering the blast furnace through the tuyeres. The tuyeres are therefore subjected to air temperatures that can well exceed 900° C. The melting point of copper is very near these temperatures at 1083° C. Any of the gas not burned in the stoves is sent to a boiler house to generate steam for turbo blowers that generate "cold blast" compressed air for the stoves.

Figure 4B:
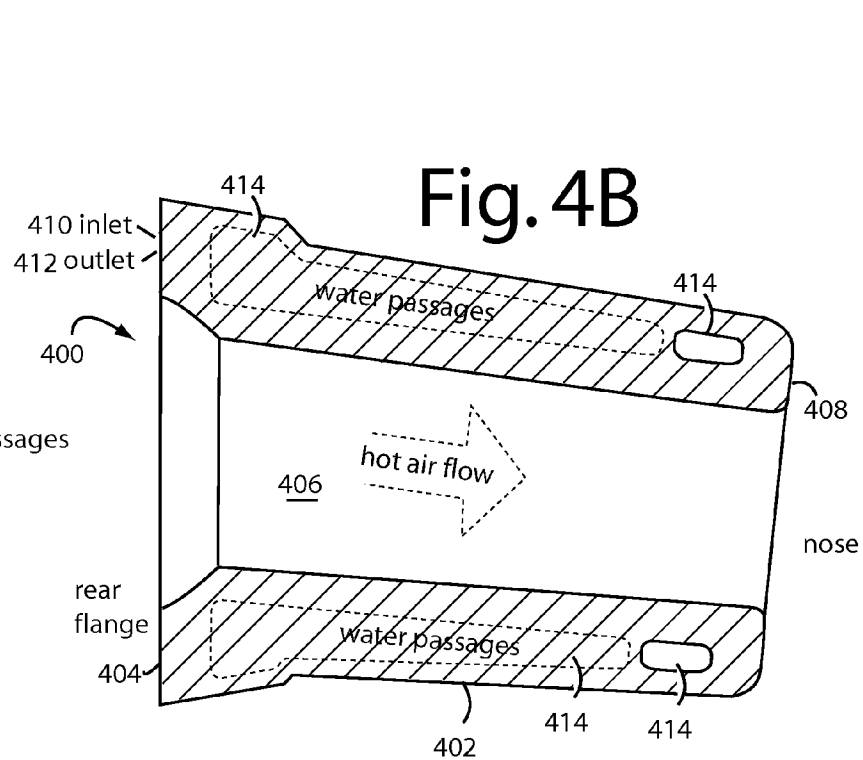
FIG. 4B is a longitudinal cross sectional diagram of the tuyere of FIG. 4A.
Figure 4A:
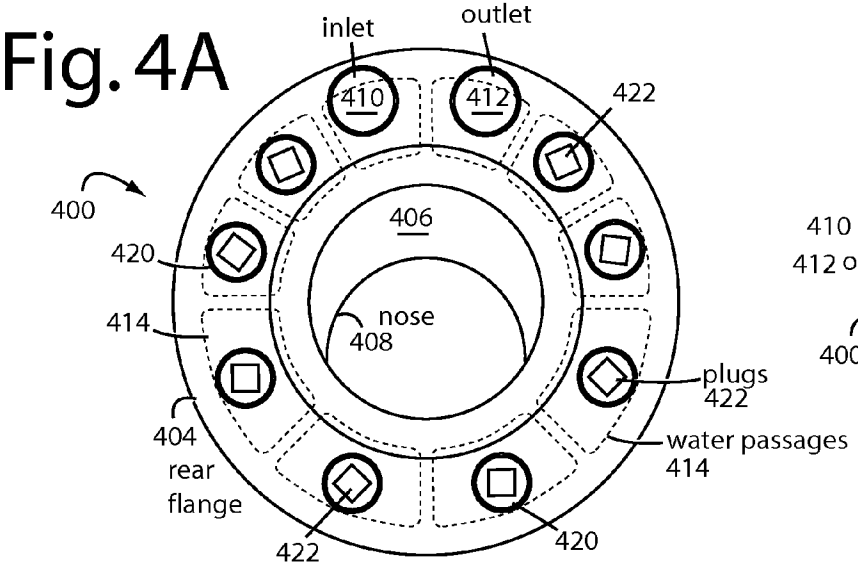
FIG. 4A is a rear view of a tuyere embodiment of the present invention useful in the blast furnace of FIG. 3.
Figure 4C:
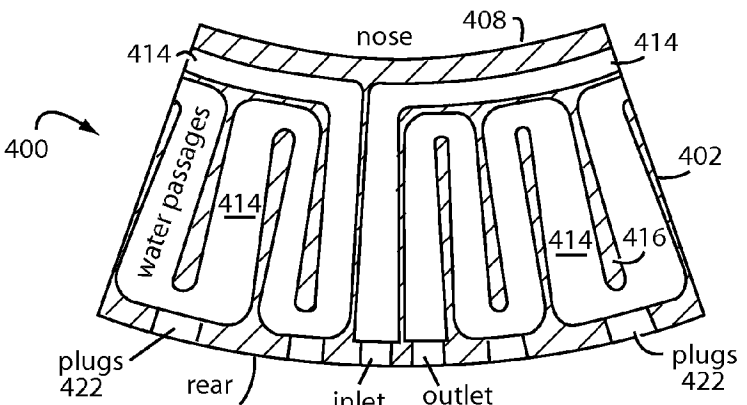
FIG. 4C is a lateral cross sectional diagram of a portion of the conical body of the tuyere of FIGS. 4A and 4B and laid out flat for this illustration.

FIGS. 4A-4C represent a tuyere embodiment of the present invention, and is referred to herein by the general reference numeral 400. Such are useful in the blast furnace 300 of FIG. 3. Tuyere 400 includes a cast metal body 402 having the general shape of a nozzle and includes a rear flange 404 that connects through a throat 406 to a nose 408 on a front end. A coolant inlet 410 and coolant outlet 412 are located on the rear flange 404 and connect to a serpentine coolant passage 414 like that described in FIGS. 1A-1C. The coolant being circulated can be water, oil, or a special liquid mixture.

The baffles that turn the coolant flow in the serpentine pattern, e.g., baffle 416, are like those described in FIGS. 1A-1C. In particular, baffles 116, and 126-131 with radius ends 119, and 144-149. The inside and outside turn radii are dimensioned and shaped to eliminate eddies in the coolant flow at these points and just downstream.

The serpentine passages 414 generally proceed in a curved plane within the conical body 402. A number of access holes 420 on an outside face of the cast metal body 402 allow the support of casting cores during metal cast, and that are sealed off with plugs 422. The plugs 422 may be conventionally pipe-threaded, welded, brazed, soldered, pressed, etc.

FIGS. 5A-5E represent a cooler 500 in an embodiment of the present invention. A plate body 502 has a coolant piping inlet 504 and outlet 506 at one end that connect to a serpentine coolant passageway 508 inside. Three baffles 520-522 turn the coolant flow around their thickened and rounded ends 523-525 inside corresponding facing corners 526-531. The geometry and rounding of these ends and corners is designed and verified by simulations, modeling and prototypes to eliminate hot spots when cooler 500 is heavily heat loaded.

Figure 6:
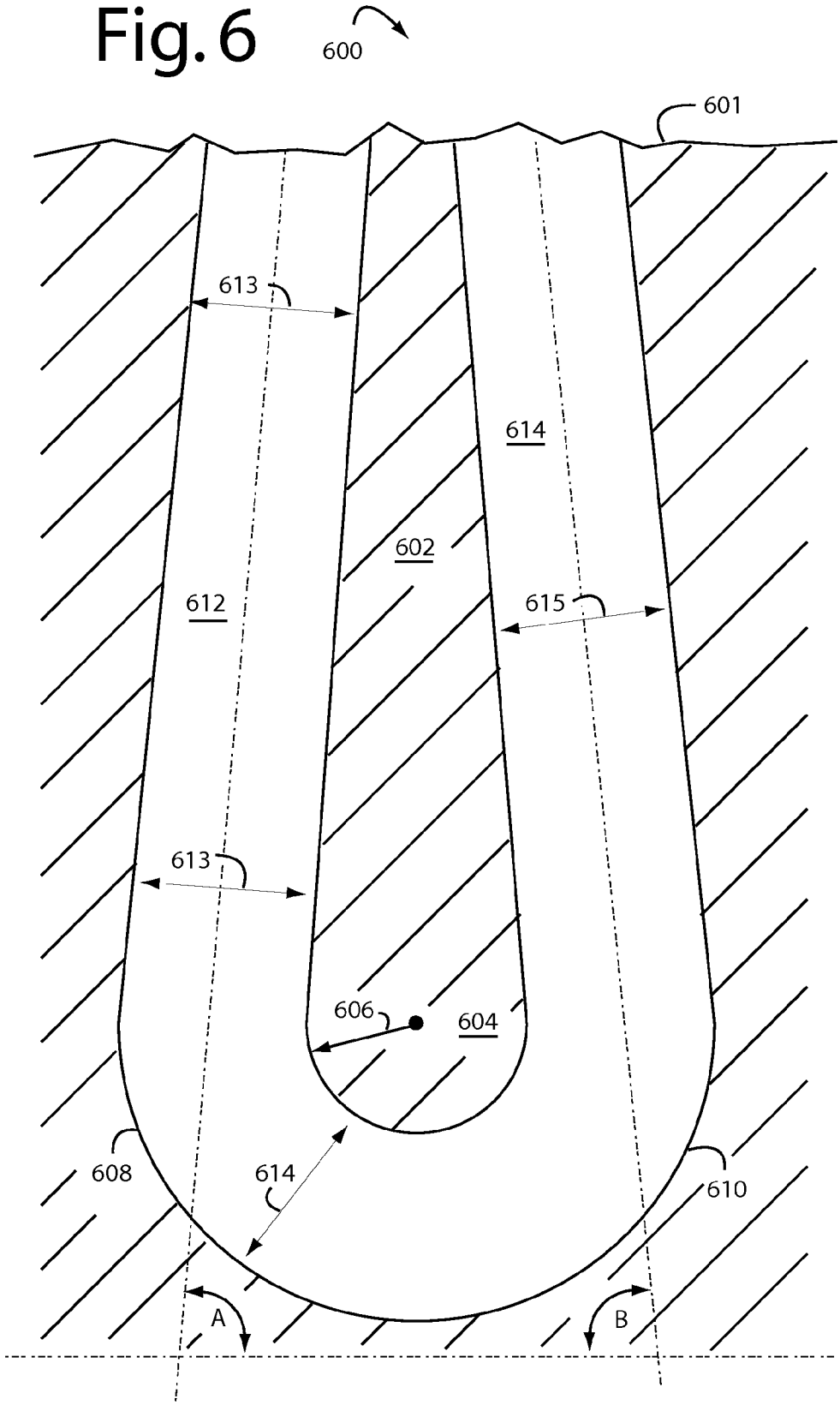
FIG. 6 is a cross sectional view diagram along the plane of a serpentine loop turn in a coolant passageway disposed in a cast or machined cooler in an embodiment of the present invention.

FIG. 6 represents a serpentine loop turn 600 in a coolant passageway disposed in a cast or machined cooler 601 in an embodiment of the present invention. A baffle 602 thickens and then rounds off at a radius end 604, e.g., in a radius 606. A pair of inside rounded corners 608 and 610 face the radius end 604. Coolant flow in a passageway loop 612 turns into a next passageway loop 614 around radius end 604 of baffle 602. The widths 613-615 are all about the same as much as is practical. The object of which is to not induce or sustain eddy flows of locally recirculating coolant after the flow turns a corner around a baffle.

In one embodiment, angles "A" and "B" are each less than 90°, and A+B is less than 180°. In other words, the center lines of passageway loops 612 and 614 are not parallel to one another. Such an arrangement would help in packing the passageway loops 612 and 614 tighter, especially where every turn is like that of FIG. 6, and the overall design of a serpentine passageway is symmetrical.

Tuyeres and other coolers can be manufactured with or without surface coatings of refractory or overlays of metal. The type, location and thickness of such overlays are not part of the claims. Coolers can be manufactured with and without grooves or pockets filled with refractory. The shape and configuration of such grooves or pockets are not part of the claims. Tuyeres can be manufactured from either a casting or a fine grained metal part. With a casting, the water passages are cast in. With a machined part, the tuyere, for example, must be made in two parts. See, U.S. Pat. No. 3,840,219, FIG. 7. The outer or inner part would be machined, and a closure piece is used to complete the cooler and close the water passages. The tuyere may be fluid or gas injected.

In general, cooler embodiments of the present invention include profiling the coolant passages for the elimination of eddies where ever the cooler can be exposed to external heat loads.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the "true" spirit and scope of the invention.

What is claimed is:

1. A tuyere, comprising:

a cast or milled metal body having a general shape of a nozzle and having a front end and outer surface for exposure to heat during operation and connections for a circulating fluid coolant;

a serpentine passageway for said circulating fluid coolant disposed in the cast or milled metal body, and generally proceeding in a single flat or curved plane;

a series of baffles disposed within the serpentine passageway and providing for turning said circulating fluid coolant in each of a series of serpentine loops;

a thickening of each one of the series of baffles towards their respective distal ends and finishing in a radius end around which said circulating fluid coolant is turned into a next one of said series of serpentine loops;

a radius of the inside of the serpentine passageway relative to said single flat or curved plane and radial to each thickening of each one of the series of baffles where said circulating fluid coolant is turned into a next one of said series of serpentine loops;

wherein, eddies in said circulating fluid coolant are eliminated.

2. The cooling system of claim 1, further comprising:

a generally rectangular cross-sectional patterning of the serpentine passageway.

3. The cooling system of claim 1, further comprising:

a number of access holes on an outside face of the cast metal workpiece to allow support of casting cores during metal cast, and that are sealed off with plugs.

4. A blast furnace, characterized by at least one tuyere including:

a cast or milled metal body having a general shape of a nozzle and having a front end for exposure to heat during operation and a back end with connections for a circulating fluid coolant;

a serpentine passageway for said circulating fluid coolant disposed in the cast or milled metal body, and generally proceeding in a single flat or curved plane;

a series of baffles disposed within the serpentine passageway and providing for turning said circulating fluid coolant in each of a series of serpentine loops;

a thickening of each one of the series of baffles towards their respective distal ends and finishing in a radius end around which said circulating fluid coolant is turned into a next one of said series of serpentine loops; and a radius of the inside of the serpentine passageway relative to said single flat or curved plane and radial to each thickening of each one of the series of baffles where said circulating fluid coolant is turned into a next one of said series of serpentine loops;

wherein eddies in said circulating fluid coolant are eliminated.

* * * * *